United States Patent [19]

Dyer

[11] 4,285,439

[45] Aug. 25, 1981

[54] WALL CONSTRUCTION FOR WIRE-BOUND BOXES HAVING SPLIT CLEATS

[75] Inventor: Harry F. Dyer, McComb, Miss.

[73] Assignee: American Box Company, Fernwood, Miss.

[21] Appl. No.: 106,922

[22] Filed: Dec. 26, 1979

[51] Int. Cl.[3] ..... B65D 6/28; B65D 6/36

[52] U.S. Cl. ..... 217/45; 217/12 A; 217/51; 217/65

[58] Field of Search ..... 217/12 R, 12 A, 13, 217/14, 16, 43 R, 43 A, 45, 46, 48, 51, 65, 69

[56] References Cited

U.S. PATENT DOCUMENTS

| | | | |
|---|---|---|---|
| 1,579,640 | 4/1926 | Brown | 217/17 |
| 1,898,177 | 2/1933 | Gooding . | |
| 1,932,550 | 10/1933 | Kempf . | |
| 1,973,932 | 9/1934 | Sharp . | |
| 1,994,108 | 3/1935 | McRill . | |
| 3,064,845 | 11/1962 | Maxwell | 217/43 R |
| 3,144,951 | 8/1964 | Knabe | 217/12 R |
| 3,182,844 | 5/1965 | Dittrick | 217/12 R |

FOREIGN PATENT DOCUMENTS

| | | | |
|---|---|---|---|
| 94168 | 3/1923 | Austria | 217/12 R |
| 468349 | 6/1952 | Italy | 217/12 R |

*Primary Examiner*—George E. Lowrance

*Attorney, Agent, or Firm*—Finnegan, Henderson, Farabow, Garrett & Dunner

[57] ABSTRACT

A wall construction for wire-bound boxes utilizing split cleats in at least one pair of opposing walls, wherein two rectangular panels or mats are aligned in the same wall, the opposing ends of the cleats of the panels being shortened for receiving therebetween an auxiliary support member, the support member being clamped between the opposing ends of the upper and lower cleats when the wires are tightened in the assembly of the walls. A face board or a pair of face boards, bridges the opposing ends of the panels and the auxiliary support member therebetween.

14 Claims, 8 Drawing Figures

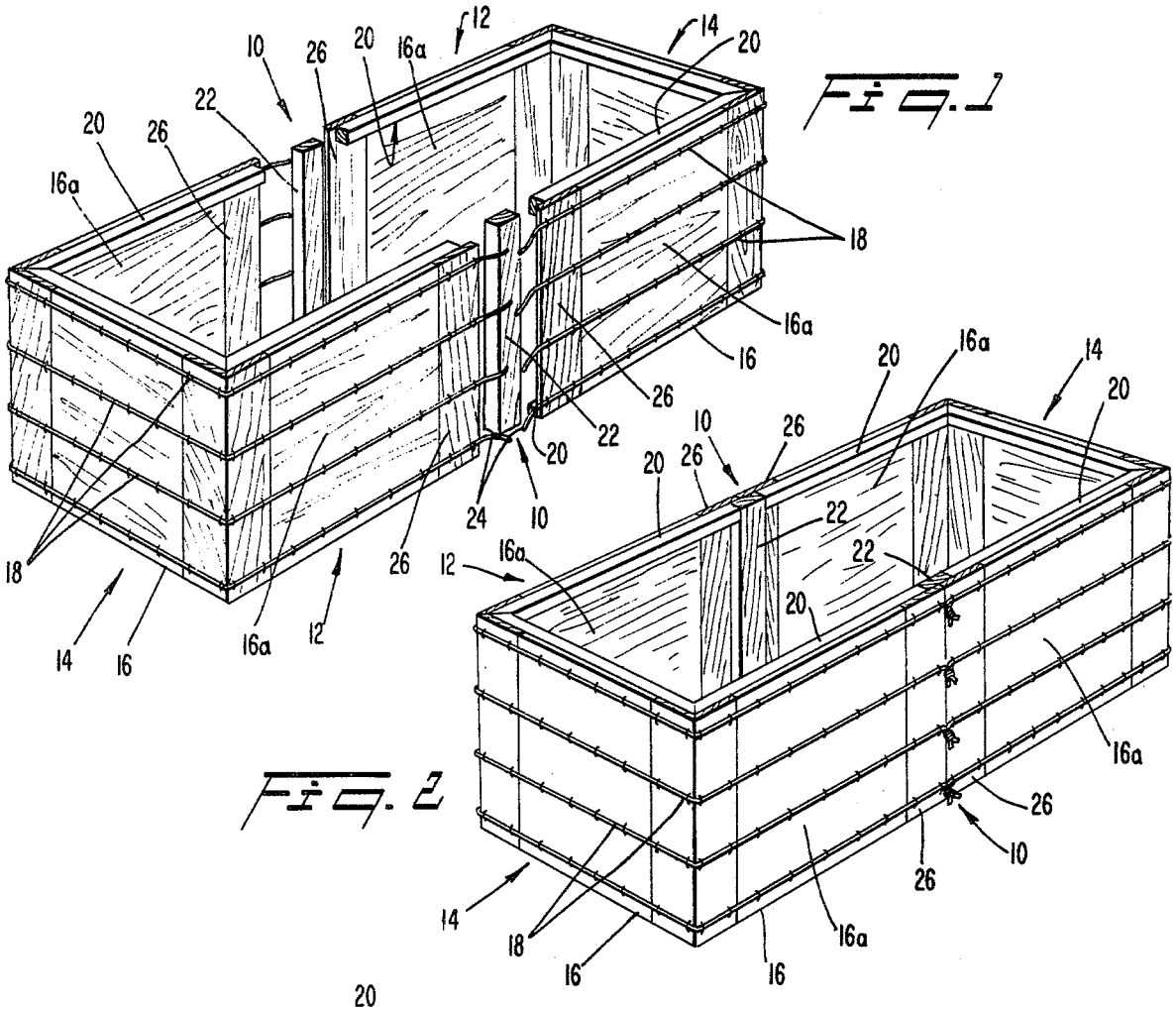
Fig. 1
Fig. 2
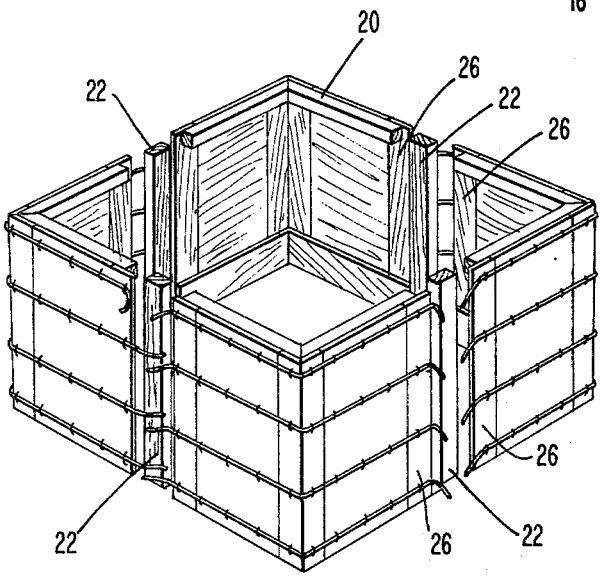
Fig. 3
Fig. 4
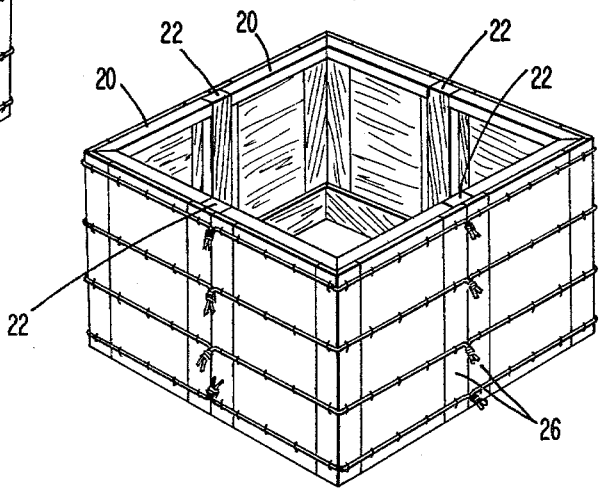

20
22
26
18
16a
26a

WALL CONSTRUCTION FOR WIRE-BOUND BOXES HAVING SPLIT CLEATS

This application relates to the construction of wire-bound boxes, and more particularly to the construction of the walls of such boxes.

BACKGROUND OF THE INVENTION

In the construction of wire-bound boxes it is conventional for the bottom, the top, and the walls to be fabricated as separate units and shipped to the customer unassembled. The units can be grouped in convenient quantities of like sizes for the most economical shipment and storage by the customer.

The user of the boxes assembles the units into box form, including threading the loops on the ends of the wires attached to the wall blank and twisting or otherwise fastening the projecting ends of the wires together to tension the wires around the walls to form the rectangular wall structure of the box.

It has been conventional for each wall of the wall structure to comprise a panel or mat, having cleats forming the top and bottom portions of the frame work of the panel. These cleats run the full length of the wall of the box and form the lateral edges of the rectangular wall. The cleats are part of the fundamental framework of the box, when assembled, giving not only strength to the box, but serving to help to maintain the rigidity of the wall of the box against collapse into a parallelogram.

Recently, the scarcity of lumber and high cost of lumber, particularly of good quality and proper length, has made the fabrication of wire-bound boxes much more expensive. In particular, good quality cleats as required in the construction of relatively long boxes, e.g., over six feet long, are not only relatively expensive, but in fact difficult to procure. It is to be understood, of course, that in wire-bound boxes, the width of the cleat is a function of the length. When the cleat is longer, it must also be wider for strength to support the weight of the contents of the box against the bottom of the box, and to avoid distortion of the walls of the box due to horizontal internal pressure by the contents of the box.

SUMMARY OF THE INVENTION

It is therefore the primary object of the invention to be able to construct strong wire-bound boxes having wall panels utilizing good quality cleats which are shorter than the length of the box.

It is an auxiliary object of the invention to manufacture long wire-bound boxes, utilizing good quality, commercially available cleats.

This invention overcomes the problems of the prior art by an improvement in the construction of wire-bound containers, where the walls of the container include rectangular panels bound together in opposing edge relationship by wires normal to the opposing edges, the panels having cleats of like thickness forming at least a portion of the edges of the panels normal to the opposing edges, the improvement comprising a set of two successive panels arranged in the same plane, and an auxiliary support member having the same thickness as the cleats inserted between the opposing edges of the successive panels, the lengths of the cleats of each of the successive panels being determined for clamping the support member between the opposing ends of the cleats of the successive panels under the normal tension of the wires binding the panels of the wire-bound container together.

The invention also includes a method for forming a wall of a wire-bound box comprising the steps of preparing a pair of rectangular panels for alignment in the same frame, each panel having cleats of like thickness forming the lateral edges of the panels, the panels having an outer surface and an inner surface and having face boards attached to the outer surfaces of the opposing ends of said panels and extending along the ends of the panels for abutment when said panels are assembled as a wall of the box, the face boards extending beyond the ends of the panels a like distance for spacing said panels apart to form a predetermined space; inserting into said space an auxiliary support member having the thickness of the cleats and the width of said space; and binding the panels together end to end with the auxiliary support member therebetween by wires parallel to the cleats.

The invention also includes a method for forming a wall of a wire-bound box comprising the steps of preparing a pair of rectangular panels for alignment in the same plane, each panel having cleats of like thickness forming a portion of the lateral edges of the panel, the opposing ends of the cleats being spaced apart a predetermined distance when said panels are assembled as a wall of the box; attaching a face board to one of the opposing ends of the aligned panels, the face board extending beyond the end of the attached panel; inserting an auxiliary support member between the ends of the cleats, the support member extending along the end of the aligned panels and having width greater than the predetermined distance and a thickness equal to the cleats, the width of the face board extending across the auxiliary support and a portion of the opposing end of the aligned panel, and binding the panels together end to end with said auxiliary support member clamped between the opposing ends of the cleats by wires parallel to the cleats.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

The accompanying drawings, which are incorporated in and constitute a part of this specification, illustrate one embodiment of the invention and, together with the description, serve to explain the principles of the invention.

BRIEF DESCRIPTION OF THE DRAWINGS

FIG. 1 is an exploded perspective view of the wall construction of a wire-bound box including the split cleats and auxiliary support member of the invention in two opposing walls before wiring the elements of the wall structure together.

FIG. 2 is a perspective view of the construction of FIG. 1 after the elements of the wall structure have been wired together.

FIGS. 3 and 4 are similar to FIGS. 1 and 2, respectively, but illustrate the construction of the invention incorporated in both pairs of opposing walls.

DESCRIPTION OF THE PREFERRED EMBODIMENT

Figure 5:
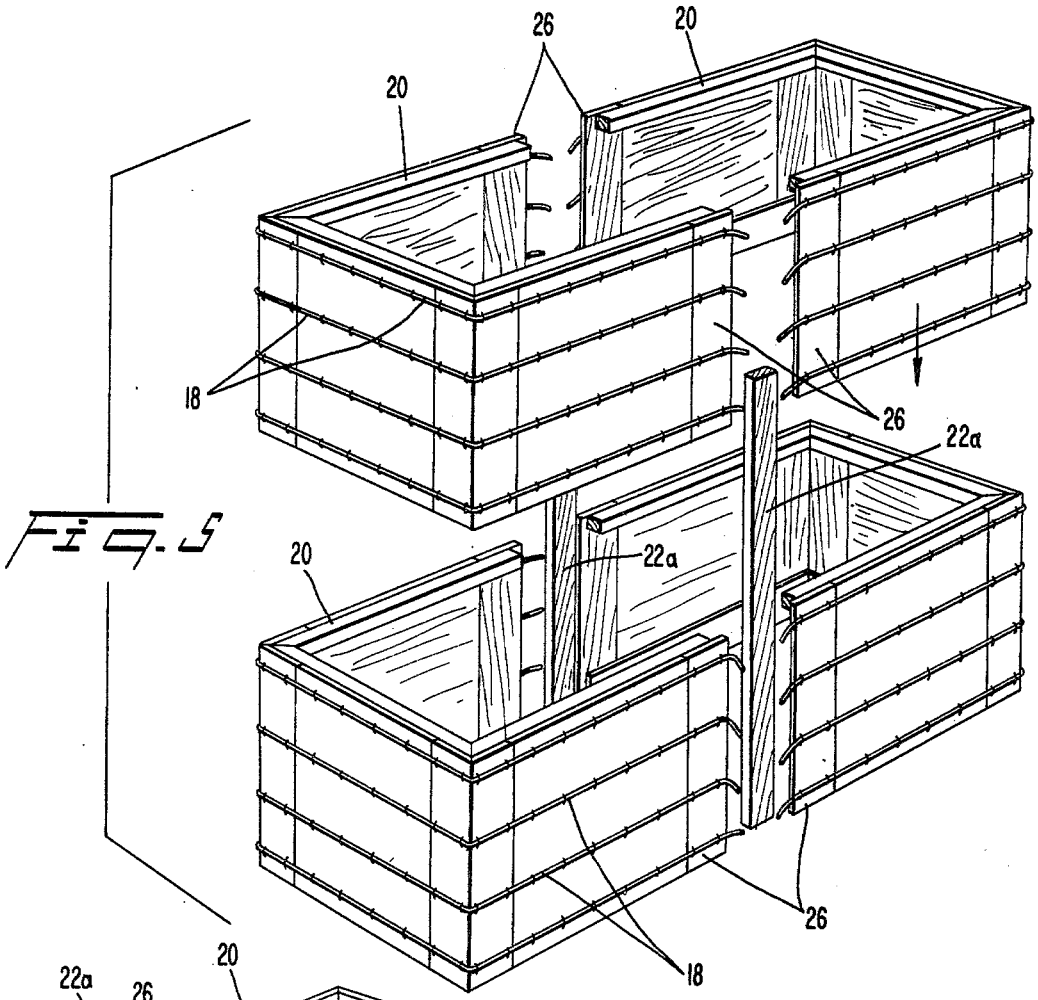
FIGS. 5 and 6 are views similar to FIGS. 1 and 2, respectively, but illustrate the construction of two stacked wall structures wherein the auxiliary support members of the invention are common to both stacked wall structures.

Referring now to FIGS. 1 and 2, the wall construction of a wire-bound container, hereafter referred to as a box, is shown including the structure of the invention numbered generally as 10.

As is conventional, the wall construction includes side walls and end walls, numbered generally as 12 and 14, respectively, wherein the walls include rectangular panels 16 bound together in opposing edge relationship by wires 18 normal to the opposing edges. The panels 16 include cleats 20 of like thickness forming at least a portion of the edges of the panels normal to the opposing edges. As is customary, the ends of the cleats 20 forming the corners of the walls of the box are beveled to provide a rectangle when the wall construction is assembled.

In accordance with the invention, a set of two panels is arranged in the same plane to form one wall of the wall construction. As embodied herein and shown generally in the exploded view of FIG. 1, each of a pair of opposing walls includes a set of two panels 16*a*.

An auxiliary support member 22 having the same thickness as the cleats 20 is inserted between the opposing edges of the successive panels 20*a*, the lengths of the cleats of each of the successive panels being determined for providing a space for insertion of the support member between the opposing ends of the cleats. In other words, the opposing ends of the cleats 20 are shortened to provide space for the auxiliary support member 22 between the opposing ends of the cleats, the support member being clamped between the opposing ends of the cleats when the projecting wnds 24 of the wires 18 are twisted, or otherwise fastened, together by the normal tension of the wires on the wire-bound box.

Preferably, in accordance with the invention, face board means bridge the auxiliary support member 22 and the opposing ends of the successive panels 16*a*, the face board means being attached to at least one of the panels for assisting in retaining the auxiliary support member in position.

As embodied herein, and shown generally in FIGS. 1 and 2, the face board means includes a pair of face boards 26 in edge-to-edge arrangement, the combined width of the pair of face boards bridging the support member 22 and the opposing ends of the successive panels 16*a*. The pair of face boards 26 is secured to individual ones of the successive panels 16*a* and the opposing edges of the pair of face boards form a line substantially at the midpoint of the width of the support member between the successive panels.

Preferably, the face boards 26 replace the vertical members which conventionally form the edge portion of the framework of the panel or mat.

In the preferred embodiment the auxiliary support member has a width of $2\frac{5}{8}''$ and the width of each of the face boards is $4\frac{5}{8}''$.

In the illustrated embodiment of the box in FIGS. 1 and 2 substantially the entire walls of the box are sheathed. In such a construction the sheathing on the successive panels 16*a* may be shortened adjacent the opposed edges of the panels and the face boards placed in the same plane as the sheathing. In such an arrangement, the face boards 26 are individually attached to the exposed ends of the cleats 20. In this arrangement, the wires 18 are attached to the face boards 26 with ends 24 of the wires extending beyond the abutting edges of the face boards.

When the ends 24 of the wires 18 are twisted together as shown in FIG. 2, the edges of the face boards 26 are drawn substantially into abutting relationship and the auxiliary support members 22 are clamped between the opposing ends of the cleats 20.

Alternatively, as well-known, the walls of the box may not be sheathed, wherein the walls are open and the wall structure is substantially the framework. In such a structure, the face boards 26 replace the conventional vertical members forming the ends of the panels or mats.

Figures 7, 8:
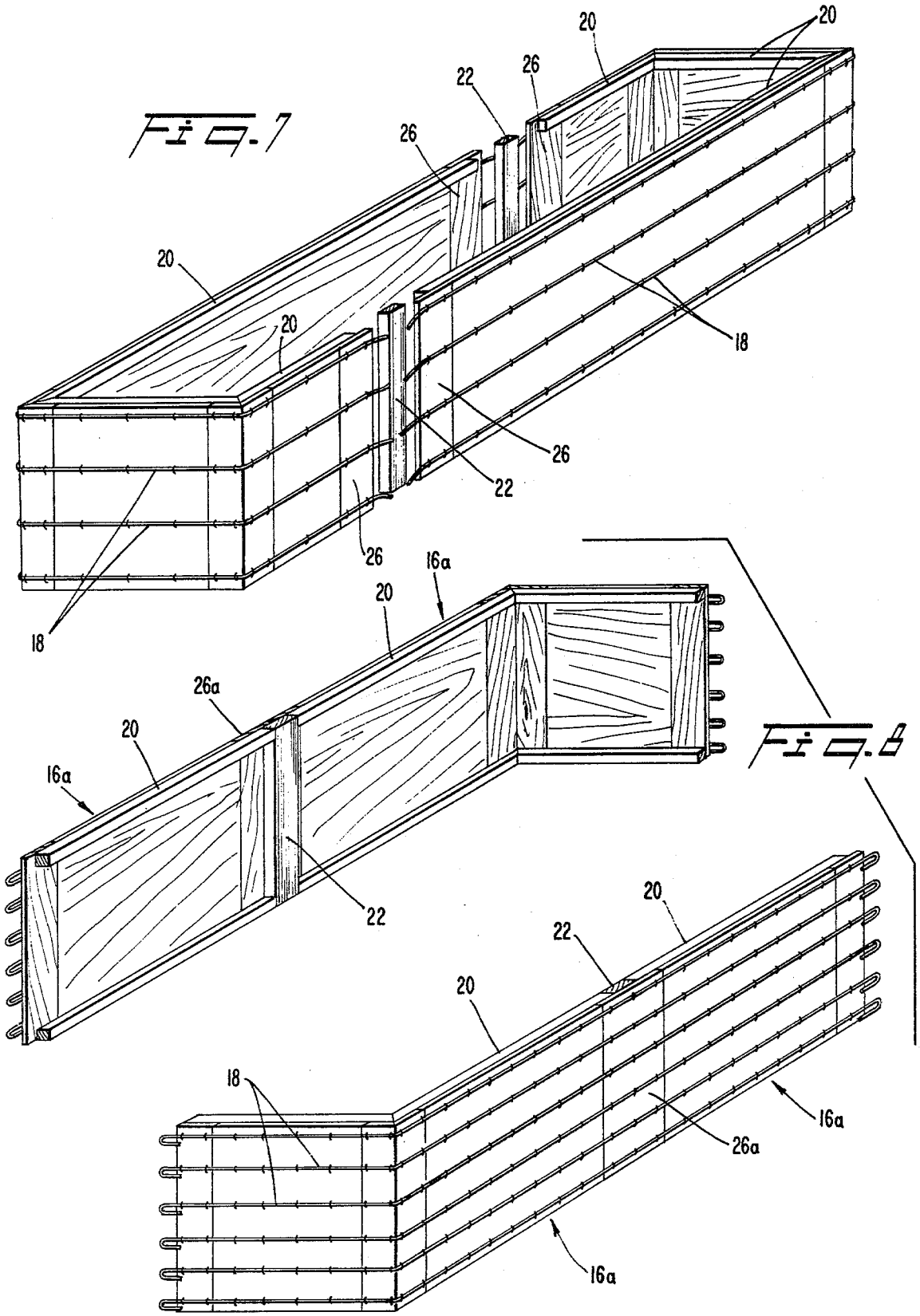
FIG. 7 is a view similar to FIG. 1 wherein the panels forming a pair of opposing walls are of different lengths and the opposing auxiliary support members are not aligned.
FIG. 8 is a perspective view of a second embodiment of the invention before wiring the elements of the wall structure together.

The face board means, may, if desired, comprise a single face board of extra width, as embodied generally in FIG. 8, the width of the face board bridging the support member 22 and the opposing ends of the successive panels 16*a*. In this construction, it is preferred that a face board 26*a* be attached to only one of the successive panels 16*a* to permit tightening of the cleats 20 on the auxiliary support member 22 when the wires 18 are drawn together in the assembly of the wall structure.

The wall structure of the invention, wherein the cleats are split into two parts and an auxiliary support member inserted between the opposing ends of the cleats, results in manifold advantages. Better quality, commercially available, shorter length cleats can be used. The auxiliary support member is a positive deterrent against partial longitudinal collapse of the wall into the form of a parallelogram. The support member also provides strong support against compressional and torsional stresses on the cleats.

The wall structure of the invention comprises at least two separate sections, each bound together by wires having ends extending beyond the edges of the face boards. Each section can therefore be manufactured with standard stitching equipment. Extra long boxes can be assembled from the sections, and wired together with standard equipment, which was not possible heretofore.

The wall structure of the invention may be incorporated into both pairs of opposing walls as shown in FIGS. 3 and 4. This embodiment is particularly useful in large boxes wherein the four walls of the boxes are substantially the same length.

As illustrated in FIGS. 1–4, the successive panels 16*a* are of substantially the same length and the auxiliary support members 22 on the opposite walls are aligned. It may be advantageous, however, for the successive panels 16*a* to be of different lengths and the auxiliary support members staggered with respect to each other, as shown in FIG. 7.

The advantage of the wall construction of FIG. 7 may arise, for example, due to the availability of cleats of certain lengths. On the other hand, the wall construction of FIG. 7 may be determined by the contents to be placed in the box or the method of transporting the box with its contents. If the box is to be supported at its ends for example, it may be advantageous for the auxiliary support members to be offset with respect to each other.

It is apparent that the offset arrangement of FIG. 7 can be used in both pairs of opposing walls.

Figure 6:
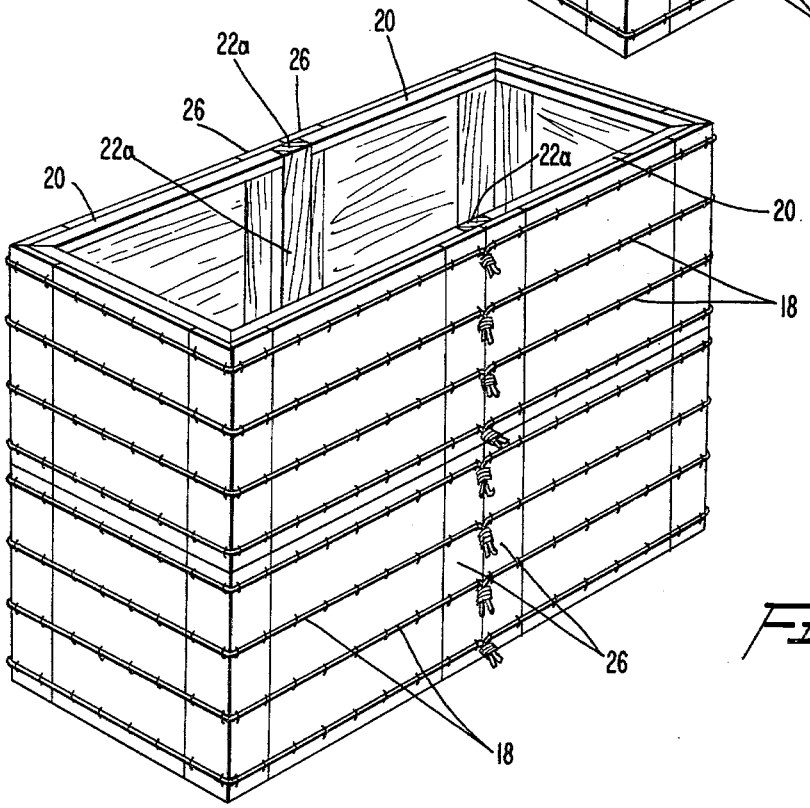

The principle of the invention can be incorporated in wire-bound boxes requiring extra height, as shown generally in FIGS. 5 and 6. In this construction two wall structures, as shown in FIGS. 1 and 2, forming two complete perimeters, are stacked with a single auxiliary support member 22*a* serving in common between the successive panels 16*a* of the stacked wall structures. This construction gives increased strength and rigidity to the taller box. It also has the advantage of utilizing standard sizes of wall structure blanks, except for the length of the inserted auxiliary support member, for different height boxes.

An ancillary advantage of the wall construction of the invention is that standard wall blanks for wire-bound boxes can be used to construct boxes of different dimensions. Successive panels of different lengths can be combined to vary the length of the box merely by inserting the auxiliary support member between the successive panels.

It will be apparent to those skilled in the art that various modifications and variations can be made in the wall structure of the present invention without departing from the scope or spirit of the invention. As an example, a wall of a wire-bound box, according to the invention, can comprise more than two successive panels, each pair of successive panels being constructed as taught herein.

Thus, it is intended that the present invention cover the modifications and variations of this invention provided they come within the scope of the appended claims and their equivalents.

What is claimed is:

1. An improvement in the construction of wire-bound containers, wherein the walls of the container include rectangular panels bound together in opposing edge relationship by wires normal to the opposing edges, the panels having cleats of like thickness forming at least a portion of the edges of said panels normal to the opposing edges, said improvement comprising:

a set of two successive panels arranged in the same plane; and an auxiliary support member having the same thickness as the cleats inserted between the opposing edges of said successive panels, the lengths of said cleats of each of the successive panels being determined for clamping said support member between the opposing ends of the cleats of the successive panels under the normal tension of the wires binding the panels of the wire-bound container together.

2. The improvement of claim 1 also including face board means bridging said support member and the opposing ends of said successive panels, said face board means being attached to at least one of said panels for assisting in retaining the support member in position.

3. The improvement of claim 2 wherein said face board means includes a single face board, the width of said face board bridging said support member and the opposing ends of said successive panels.

4. The improvement of claim 2 wherein said face board means includes a pair of face boards in edge-to-edge arrangement, the combined width of said pair of face boards bridging said support member and the opposing ends of the successive panels, said pair of face boards being secured to individual ones of said successive panels and the opposing edges of said pair of face boards forming a line defining substantially the midpoint of the width of said support member between said successive panels.

5. The improvement of claim 4 wherein said container is a box including two sets of said successive panels, said sets being arranged as opposing walls of the wire-bound container, each of said two sets of panels including a said support member inserted between the respective successive panels, and said face board means bridging the support member and the opposing ends of the panels forming the set of panels.

6. The improvement of claim 5 wherein said individual support members clamped between said successive panels of said sets are in opposing aligned positions in the walls of said wire-bound container.

7. The improvement in claim 5 wherein said individual support members clamped between said successive panels of said sets are in staggered positions with respect to each other in opposing walls of said wire-bound container.

8. The improvement of claim 6 or 7 also including said sets of panels in both of the pairs of opposing walls of said box.

9. The improvement of claim 5 wherein at least one pair of opposing walls of said box includes a plurality of sets of panels in each wall.

10. The improvement of claim 4, 5, 6, 7, or 9, wherein said wires have terminal portions extending beyond the opposing edges of said pair of face boards for securing the successive panels together and for applying clamping pressure on said support member.

11. The improvement of claim 4, 5, 6, 7, or 9, wherein the width of each of the pair of face boards is $4\frac{5}{8}''$.

12. The improvement of claim 1, 2, 4, 5, 6, 7 or 9, wherein the walls of said container include two complete perimeters of said container, each perimeter including said sets of successive rectangular panels bound together by wires normal to the opposing edges of the panels, said perimeters being in stacked relationship and wherein each support member is elongated and common to both of said perimeters.

13. The improvement of claim 12 also including an additional cleat intermediate and parallel to said edge cleats.

14. The improvement of claim 1 wherein the width of said support member is $2\frac{5}{8}''$.

* * * * *